US006089067A

United States Patent [19]

Yoshioka et al.

[11] Patent Number: 6,089,067

[45] Date of Patent: Jul. 18, 2000

[54] FURNACE COILER

[75] Inventors: Takahiro Yoshioka; Makoto Obara, both of Hitachi; Osamu Sugimoto, Tokai-mura, all of Japan

[73] Assignee: Hitachi, Ltd., Tokyo, Japan

[21] Appl. No.: 09/246,724

[22] Filed: Feb. 9, 1999

[30] Foreign Application Priority Data

Feb. 10, 1998 [JP] Japan ..... 10-028003

[51] Int. Cl.[7] ..... B21C 47/00; B21B 27/06

[52] U.S. Cl. ..... 72/148; 72/202

[58] Field of Search ..... 72/200, 202, 231, 72/229, 148, 146, 128; 242/590, 596.3, 596.8

[56] References Cited

U.S. PATENT DOCUMENTS

| | | | |
|---|---|---|---|
| 5,009,092 | 4/1991 | Buchegger | 72/202 |
| 5,269,166 | 12/1993 | Thomas | 72/202 |
| 5,848,543 | 12/1998 | White | 72/202 |

*Primary Examiner*—Rodney A. Butler

*Attorney, Agent, or Firm*—Antonelli, Terry, Stout & Kraus, LLP

[57] ABSTRACT

A furnace coiler capable of facilitating maintenance work and improving the yield and the productivity of the associated rolling system has a housing having an upper housing portion), a lower housing portion and a bottom housing portion. The bottom housing portion can be moved together with movable table rollers relative to the lower housing portion to opening the housing for maintenance work.

5 Claims, 3 Drawing Sheets

FURNACE COILER

BACKGROUND OF THE INVENTION

The present invention relates to a furnace coiler for winding a strip to be rolled by a hot rolling mill, while keeping the strip hot or heating the strip.

In a conventional hot rolling system, a furnace coiler takes up a strip rolled by a hot rolling mill and heats the strip. As mentioned in, for example, U.S. Pat. No. 5,269,166 and Japanese Patent Laid-open Nos. Hei. 7-47422 and Hei. 8-332503, a furnace coiler, having a housing and a mandrel disposed in the housing, takes up a strip which moves on table rollers into the housing and around the mandrel to form a coil and heats the coil.

Internal devices of the furnace coiler, including the mandrel and strip guides, and the furnace walls of the furnace coiler are exposed to severe thermal conditions. Therefore, those internal devices and the furnace walls have short lifetimes and require frequent maintenance work. For example, the interior of the furnace coiler needs to be inspected nearly once every week for maintenance. However, the maintenance of the conventional furnace coiler is difficult. The conventional furnace coiler has a lower housing portion, and an upper housing portion fixed to the lower housing portion with bolts or the like, and the lower housing portion is provided with an inlet opening to receive a strip therethrough into the furnace coiler. As an example, a typical furnace coiler may be 4 m in diameter and 2 m in width, and the inlet opening is then as small as 2 m in width and only about 1 m in height. Therefore, it is impossible for a man to enter the housing for maintenance work. As a result, when removing the internal devices including the mandrel and the strip guides from the housing, the upper housing portion of the furnace coiler must be removed. Since the upper housing portion is a heavy structure of about 30 tons, it takes two days for four men to remove the upper housing portion from and reassemble the same with the lower housing portion.

Since, the housing is closed, except for the inlet opening, it takes a very long time of about 10 hours for the furnace coiler to cool down after the furnace coiler has been stopped.

Accordingly, the conventional furnace coiler has problems in that it requires difficult and frequent maintenance work, which reduces the yield and the productivity of the associated rolling system.

Accordingly, it is an object of the present invention to provide a furnace coiler which does not require difficult maintenance work and which is capable of improving the yield and the productivity of the associated rolling system.

SUMMARY OF THE INVENTION (1) With the foregoing object in view, the present invention provides a furnace coiler having a housing including an upper housing portion, a lower housing portion fixed to the upper housing portion, and a mandrel disposed in the housing having the upper and the lower housing portions to take up a strip, and in which housing there is also provided a bottom housing portion, separate from the lower housing portion and mounted in a bottom part thereof, the bottom housing portion being movable relative to the lower housing portion.

In this furnace coiler, the bottom housing portion can easily be moved, and so an opening formed by moving the bottom housing portion can be used for cooling the interior of the housing, thereby to facilitate maintenance work and to improve the yield and the productivity of the associated rolling system.

(2) In the furnace coiler mentioned in paragraph (1), it is preferable that table rollers are disposed below the furnace coiler to pass a strip to be worked through a rolling mill, and some of the table rollers are movable together with the bottom housing portion.

The bottom housing portion can easily be moved together with the movable table rollers.

(3) In the furnace coiler mentioned in paragraph (1), it is preferable that a joint between the lower housing portion and the bottom housing portion has a heat insulating construction.

The heat insulating joint prevents heat leakage and improves safety.

(4) With the foregoing object in view, the present invention provides a furnace coiler having a housing including an upper housing portion, a lower housing portion fixed to the upper housing portion, and a mandrel disposed in the housing formed by the upper housing and the lower housing to take up a strip, and in which the housing has a bottom housing portion, separate from the lower housing portion and mounted in a bottom part thereof, the bottom housing portion being swingable relative to the lower housing portion.

In this furnace coiler, the bottom housing portion can easily be moved, so that an opening formed by moving the bottom housing portion can be used for cooling the interior of the housing, thereby to facilitate maintenance work and to improve the yield and the productivity of the associated rolling system.

DETAILED DESCRIPTION OF THE PREFERRED EMBODIMENTS

A furnace coiler representing a first embodiment according to the present invention will be described with reference to FIGS. 1 and 2.

First, a hot rolling system including the furnace coiler according to the first embodiment will be described with reference to FIG. 1.

Figure 1:
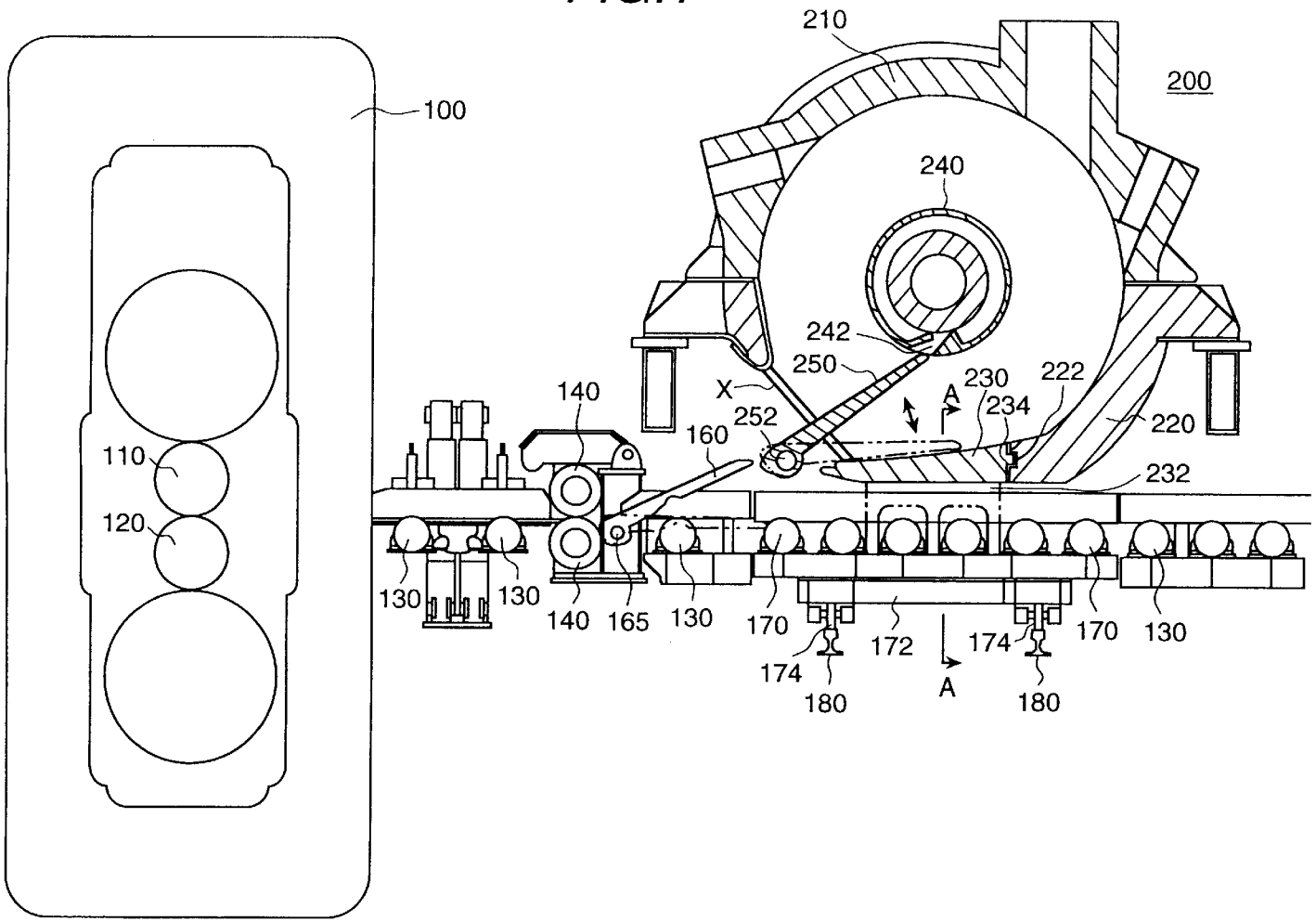
FIG. 1 is a front view of a hot rolling system including a furnace coiler representing a first embodiment according to the present invention.

FIG. 1 is a front view of a hot rolling system including the furnace coiler according to the present invention.

A reversing rolling mill 100 presses a hot strip or a hot slab between an upper roll 110 and a lower roll 120 for rolling. Furnace coilers 200 for keeping the strip hot or heating the strip are installed on the front and the back sides of the reversing rolling mill 100. Only one of the furnace coilers 200 is shown in FIG. 1. The two furnace coilers 200 are disposed in a symmetrical positional relation with respect to the reversing rolling mill 100.

Table rollers 130 are disposed adjacent to the reversing rolling mill 100. The strip or the slab to be worked is carried by the table rollers 130 for forward and backward movement so that the strip or the slab is worked repeatedly for rolling by the reversing rolling mill 100. The strip to be worked is moved forward or backward by pinch rollers 140 driven by a motor.

During a normal rolling operation, a lower guide 160 is set at its lower position where the lower guide 160 is included in a plane in contact with the upper parts of the table rollers 130 to avoid obstructing the movement of the strip. When the rolled strip is to be taken up by, the furnace coiler 200, the lower guide 160 is turned upward on a pivot pin 165 connected to one end thereof to guide the rolled strip delivered from the reversing rolling mill 100 toward the inlet opening of the furnace coiler 200.

The furnace coiler 200 in this first embodiment has a housing including an upper housing portion 210, a lower housing portion 220 and a bottom housing portion 230. The first embodiment is characterized by the housing being provided with the bottom housing portion 230 in addition to the upper housing portion 210 and the lower housing portion 220.

The upper housing portion 210 and the lower housing portion 220 are fastened together with bolts or the like. On the other hand, the bottom housing portion 230 is not fastened to the lower housing portion 220 and can be moved toward a side of the furnace coiler 200 (in a direction out of the paper as seen in FIG. 1). For this purpose, the bottom housing portion 230 is fixed to brackets 232 attached to a movable table base 172 supporting removable table rollers 170, which carry the slab to be worked similar to rollers 130.

The removable table rollers 170 may be separated from the adjacent stationary table rollers 130. Wheels 174 disposed under the movable base 172, which carries the removable table rollers 170, roll on rails 180 fixedly laid on a base surface. Thus, the bottom housing portion 230, fixedly held on the movable table base 172, can be pulled out toward the side of the furnace coiler by moving the table base 172 on the wheels 174 in a direction out of the paper, as seen in FIG. 1.

A groove 222 is formed in an end part of the lower housing portion 220, and a ridge 234 is formed in an end part of the bottom housing portion 230, with the ridge 234 of the bottom housing portion 230 being fitted in the groove 222 of the lower housing 220 in a tongue-and-groove type joint to prevent flames produced in the heating furnace from leaking outside. The tongue-and-groove type joint prevents a reduction in the efficiency of the heating furnace due to leakage of heat, which is generated in the heating furnace for keeping a strip hot or heating a strip, through gaps between the lower housing portion 220 and the bottom housing portion 230, and improves safety by preventing high-temperature hot air from blowing out through the gaps. A clearance is formed between the bottom housing portion 230 and the lower housing 220 to prevent thermal deformation.

The furnace coiler 200 is internally provided with a mandrel 240. The mandrel 240 is driven for rotation by a motor to take up the strip. The motor which operates to rotate the mandrel 240 is disposed on the other side of the furnace coiler 200 opposite the operating side and, therefore, the removable table rollers 170 can be pulled out toward the operating side.

The furnace coiler 200 has an opening X, and an upper guide 250 is disposed in the opening X to guide the leading edge of the strip to the mandrel 240 at the start of a strip winding operation. The upper guide 250 turns on a pivot pin 252 placed at one end of the upper guide 250. At the start of the strip winding operation, the upper guide 250 is turned upwardly to guide the leading edge of the strip guided thereto by the lower guide 160 to a gripping slit 242 formed in the mandrel 240. Upon the start of a normal winding operation after the leading edge of the strip has been gripped by the mandrel 240, the upper guide 250 is turned downward on the pivot pin 252 so that the upper guide 250 will not interfere with the strip wound on the mandrel 240 during the normal winding operation.

The furnace coiler 200 is provided with other devices including a heating device, not shown, for keeping the strip hot or for heating the strip.

A bottom housing portion moving mechanism included in the furnace coiler 200 in this first embodiment will be described with reference to FIG. 2.

Figure 2:
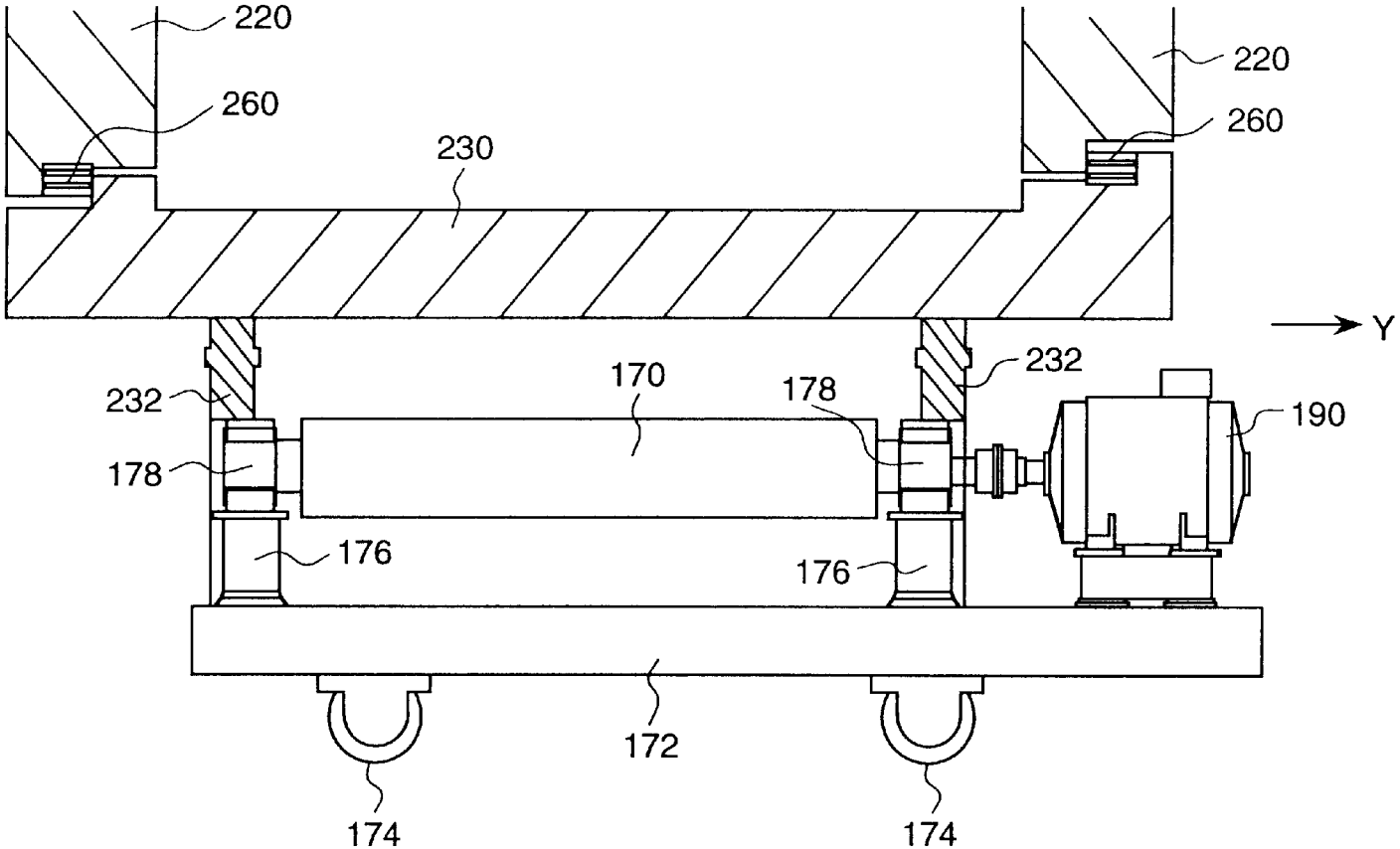
FIG. 2 is a sectional view taken on line A—A in FIG. 1, illustrating a bottom housing moving mechanism included in the furnace coiler in the first embodiment according to the present invention.

FIG. 2 is a sectional view taken on line A—A in FIG. 1, illustrating the bottom housing portion moving mechanism included in the furnace coiler in this first embodiment according to the present invention.

The removable table rollers 170 are supported for rotation in bearings 178 fixedly held on brackets 176, which are fixedly mounted on the movable table base 172 supporting the removable table rollers 170. The removable table rollers 170 are driven for rotation by motors 190. The bottom housing portion 230 is fixed to the brackets 232, which are fixedly mounted on the movable table base 172. The wheels 174 are attached to the lower surface of the movable table base 172, so that the movable table base 172 can be moved along the rails 180 shown in FIG. 1 in the direction of the arrow Y (toward the operating side of the furnace coiler 200). The bottom housing portion 230 can be moved in the direction of the arrow Y together with the removable table rollers 170.

The bottom housing portion 230 and the removable table rollers 170 are moved mechanically by a cylinder actuator, not shown, or the like. Thus, the bottom housing portion 230 can easily be moved, and an opening formed by moving the bottom housing portion 230 facilitates maintenance work. When removing the upper housing portion of the conventional furnace coiler, the bolts fastening the upper housing portion to the lower housing portion must be removed and the upper housing portion must be lifted up and carried away by a crane or the like, these upper housing removing steps being reversed conventionally when assembling the upper housing portion and the lower housing portion. Thus, work for removing the upper housing portion from the lower housing portion and assembling the upper housing portion and the lower housing portion takes two days conventionally. On the other hand, work for moving the bottom housing portion 230 can be accomplished in a half day in accordance with the present invention. Whereas work for removing the upper housing portion needs four men conventionally, work for moving the bottom housing portion 230 needs only two men.

The bottom housing portion be moved even while the interior of the furnace coiler 200 is hot. The opening formed in the housing after the bottom housing portion 230 has been removed may have a large area up to the sum of the area of an opening corresponding to the bottom housing portion 230 and the area of the opening X, and is, for example, 2 m in width and 2.5 m in height. Since such a large opening is formed in the housing, the interior of the furnace coiler 200 can cool down in a short time. Whereas it takes, for example, 10 hours for the interior of the furnace coiler 200 to cool down when an opening of 2 m in width and 1 m in height is formed in the housing conventionally, it takes only 5 hours for the interior of the furnace coiler 200 to cool down when an opening of 2 m in width and 2.5 m in height is formed in the housing.

As shown in FIG. 2, heat-insulating sealing members 260 are placed in the contact surfaces between the lower housing portion 220 and the bottom housing portion 230 to prevent the leakage of heat through gaps between the lower housing portion 220 and the bottom housing portion 230. The heat-insulating sealing members 260 may be made of a material formed by covering a ceramic fiber bracket with a ceramic fiber cloth. The heat-insulating sealing members 260 serve also as cushioning members which relieve impact of collision between the lower housing portion 220 and the bottom housing portion 230 when the bottom housing portion 230 and the removable table rollers 170, having been pulled out toward the operating side for maintenance, are returned to the furnace coiler 200 after the completion of maintenance.

Maintenance work for the maintenance of the internal components of the furnace coiler 200 will be described below.

After the operation of the furnace coiler 200 has been stopped, the movable table base 172, which carries the bottom housing portion 230 and the removable table rollers 170, is moved along the rails 180 toward the operating side, and the furnace coiler 200 is left to cool down naturally. After the furnace coiler 200 has cooled down, the operators enter the space formed by removal of the bottom housing portion 230 and execute maintenance work for the maintenance of the furnace equipment, including the mandrel 240, the upper guide 250, the furnace walls, the heating device and the like. After the maintenance work has been accomplished, the movable table base 172, which carries the bottom housing portion 230 and the removable table rollers 170, is moved back into the furnace coiler 200 so that the bottom housing portion 230 is joined to the lower housing portion 220.

Although the bottom housing portion 230 and the removable table rollers 170 are moved toward the operating side (in a direction out of the paper as seen in FIG. 1) in this embodiment, the bottom housing portion 230 and the removable table rollers 170 may be moved down into and kept in a hollow formed under the area of the movable table base 172.

As is apparent from the foregoing description, in the first embodiment, the upper housing portion need not be removed, the bottom housing portion and the removable table rollers can easily be moved, and hence the maintenance of the furnace coiler can easily be carried out.

Since a large opening can be formed by moving the bottom housing portion, the interior of the furnace coiler is able to cool down in a short time, and thereby the time necessary for maintenance can be reduced.

Since the bottom housing portion and the lower housing portion are joined by a tongue-and-groove type joint, the leakage of heat can be prevented and safety can be improved.

A furnace coiler representing a second embodiment according to the present invention will be described with reference to FIG. 3.

Figure 3:
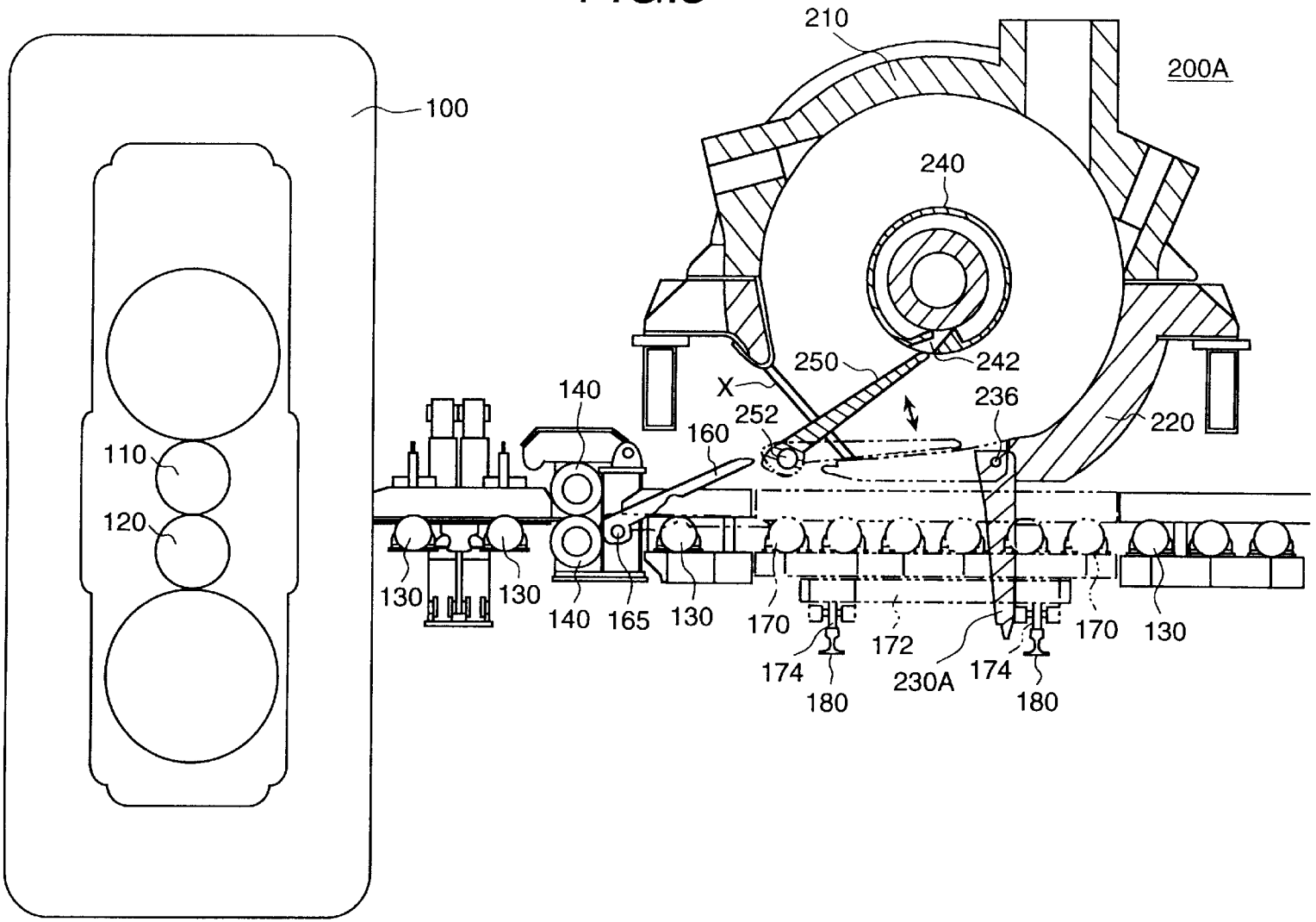
FIG. 3 is a front view of a hot rolling system including a furnace coiler representing a second embodiment according to the present invention.

FIG. 3 is a front view of a hot rolling system including the furnace coiler of the second embodiment according to the present invention, in which parts like or corresponding to those shown in FIG. 1 are designated by the same reference characters.

The hot rolling system shown in FIG. 3 is similar to that shown in FIG. 1, except that the furnace coiler 200A included in the hot rolling system shown in FIG. 3 is different from the furnace coiler 200 included in the hot rolling system shown in FIG. 1.

Furnace coilers 200A for keeping a strip hot or heating the strip are installed on the front and the back sides of a reversing rolling mill 100. Only one of the furnace coilers 200A is shown in FIG. 3. The two furnace coilers 200A are disposed in a symmetrical positional relation with respect to the reversing rolling mill 100.

The furnace coiler 200A in the second embodiment has a housing having an upper housing portion 210, a lower housing portion 220 and a bottom housing portion 230A.

The upper housing portion 210 and the lower housing portion 220 are fastened together with bolts or the like. The bottom housing portion 230A is supported on the lower housing portion 220 by a pivot pin 236 so as to be rotatable on the pivot pin 236.

Removable table rollers 170 may be separated from adjacent fixed table rollers 130. Wheels 174 are disposed under the movable table base 172, which carries table rollers 170, and roll on rails 180 fixedly laid on a base surface to move the movable table base 172 with the removable rollers 170. The movable table base, which carries the removable rollers 170, can be pulled out toward the operating side.

The furnace coiler 200A is internally provided with a mandrel 240. The mandrel 240 is driven for rotation by a motor to take up the strip. The motor is disposed on the other side of the furnace coiler 200A opposite the operating side and, therefore, the movable table base 172 which carries the rollers 170 can be pulled out toward the operating side.

The furnace coiler 200A has an opening X, and an upper guide 250 is disposed in the opening X to guide the leading edge of the strip to the mandrel 240 at the start of a strip winding operation. The upper guide 250 turns on a pivot pin 252 placed at one end of the upper guide 250. At the start of the strip winding operation, the upper guide 250 is turned upwardly to guide the leading edge of the strip guided thereto by a lower guide 160 to a strip gripping slit 242 formed in the mandrel 240. Upon the start of a normal winding operation after the leading edge of the strip has been gripped by the mandrel 240, the upper guide 250 is turned downward on the pivot pin 252 so that the upper guide 250 will not interfere with the strip wound on the mandrel 240 during the normal winding operation.

The furnace coiler 200A is provided with other devices including a heating device, not shown, for keeping the strip hot or for heating the strip.

The bottom housing portion 230A is operated and the movable table base 172 are moved mechanically by cylinder actuators, not shown. Thus, the bottom housing portion 230A can easily be turned, and an opening formed after opening the bottom housing portion 230A facilitates maintenance work.

Maintenance work for the maintenance of the internal components of the furnace coiler 200A will be described below.

After the operation of the furnace coiler 200A has been stopped, the movable table base 172, which carries the removable table rollers 170, is moved along the rails 180 toward the operating side, and the bottom housing portion 230A is opened and the furnace coiler 200A is left to cool down naturally. After the furnace coiler 200A has cooled down, the operators enter the space formed by removal of the bottom housing portion 230A and execute maintenance work for the maintenance of the furnace equipment, including the mandrel 240, the upper guide 250, the furnace walls, the heating device and the like. After the maintenance work has been accomplished, the bottom housing portion 230A is closed and the movable table base 172, which carries the removable rollers 170, is moved back into the furnace coiler 200A.

As is apparent from the foregoing description, the upper housing portion does not need to be removed, the bottom housing portion can easily be opened, the removable table rollers can easily be moved, and hence maintenance work is facilitated.

Since a large opening can be formed by pivoting the bottom housing portion to an open position, the interior of the furnace coiler can be cooled down in a short time and thereby the time necessary for maintenance can be reduced.

As is apparent from the foregoing description, according to the present invention, the maintenance of the furnace coiler can easily be carried out and the yield and the productivity of the rolling system can be improved.

We claim:

1. A furnace coiler, comprising:

a housing including an upper housing portion and a lower housing portion fixed to the upper housing portion and having an opening therein for the passage of a strip into and out of said housing;

a mandrel disposed in said housing to take up a strip;

a guide member disposed in said opening of the lower housing portion to guide a leading edge of a strip to the mandrel through said opening;

wherein the housing further has a movable bottom housing portion separate from the lower housing portion and placed in a bottom part thereof; and a moving apparatus for moving the movable bottom housing portion relative to the lower housing portion toward an operation side of said furnace coiler.

2. The furnace coiler according to claim 1, further comprising table rollers disposed below the furnace coiler to pass a strip to be worked through a rolling mill, wherein some of the table rollers are movable together with the movable bottom housing portion toward the operation side of said furnace coiler.

3. The furnace coiler according to claim 1, wherein sealing members are placed at a contact portion between the lower housing portion and the bottom housing portion.

4. The furnace coiler according to claim 3, wherein the sealing members are made of ceramic materials.

5. A furnace coiler, comprising:

a housing including an upper housing portion and a lower housing portion fixed to the upper housing portion and having an opening therein for the passage of a strip into and out of said housing;

a mandrel disposed in the housing take up a strip;

a guide member disposed in said opening of the lower housing portion to guide a leading edge of a strip to the mandrel through said opening;

wherein the housing further has a movable bottom housing portion provided with the lower housing portion and forming a part thereof;

table rollers disposed below the furnace coiler to pass a strip to be worked through a rolling mill, and means for moving some of said table rollers below the coiler housing toward an operation side of said furnace coiler; and a moving apparatus to swing an end of the movable bottom housing portion to a position below the table rollers after the movable table rollers are moved toward said operation side of said furnace coiler by said means for moving.

* * * * *